US006432264B2

(12) United States Patent
Prough et al.

(10) Patent No.: US 6,432,264 B2
(45) Date of Patent: Aug. 13, 2002

(54) METHOD OF MAKING A VESSEL ASSEMBLY FOR HANDLING COMMINUTED CELLULOSIC FIBROUS MATERIAL

(75) Inventors: J. Robert Prough, Saratoga Springs, NY (US); Jerry R. Johanson, San Luis Obispo, CA (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 09/900,027

(22) Filed: Jul. 9, 2001

Related U.S. Application Data

(62) Division of application No. 09/318,797, filed on May 26, 1999, now Pat. No. 6,280,575.
(60) Provisional application No. 60/087,332, filed on May 29, 1998, now abandoned.

(51) Int. Cl.[7] ..... D21C 7/12
(52) U.S. Cl. ..... 162/17; 162/18; 162/52; 162/246; 222/216; 222/564
(58) Field of Search ..... 162/17, 18, 41, 162/47, 52, 238, 246, 248; 34/367, 368, 384; 222/216, 564, 630; 414/325

(56) References Cited

U.S. PATENT DOCUMENTS 4,295,915 A 10/1981 Sakaguchi et al.
4,531,876 A * 7/1985 Gessler ..... 414/325
4,958,741 A * 9/1990 Johanson ..... 220/83
5,112,429 A 5/1992 Costas
5,232,540 A 8/1993 Southwell et al.
5,470,420 A 11/1995 Yokajty
5,500,083 A * 3/1996 Johanson ..... 162/17
5,520,773 A 5/1996 Hollis et al.
5,582,644 A * 12/1996 Gaddis et al. ..... 118/303
5,617,975 A 4/1997 Johanson et al.
5,628,873 A 5/1997 Johanson et al.
5,635,025 A * 6/1997 Bilodeau ..... 162/17
5,700,355 A 12/1997 Prough

* cited by examiner

*Primary Examiner*—Dean T. Nguyen
(74) *Attorney, Agent, or Firm*—Nixon & Vanderhye P.C.

(57) ABSTRACT

In a cellulose pulp handling vessel having a first diameter material storing or treating portion above a second diameter discharge which is at least 20% less than the first diameter, reduced compression of the material and reduced power requirements of an agitator (if used), compared to prior art constructions are provided. A first transition, preferably a substantially smooth interior surface substantially frusto-conical transition, is provided between the first and second diameters. A second single-convergent transition may be provided above the first transition. A rotating agitator with at least two arms and associated paddles may be mounted for rotation in the transition about a substantially vertical axis for agitating the material in the transition. If desired, the transition may be moved, such as with a vibrator or oscillator. The invention is particularly suitable for pulp digesters and impregnation vessels.

5 Claims, 3 Drawing Sheets

Fig. 2 (Prior Art)
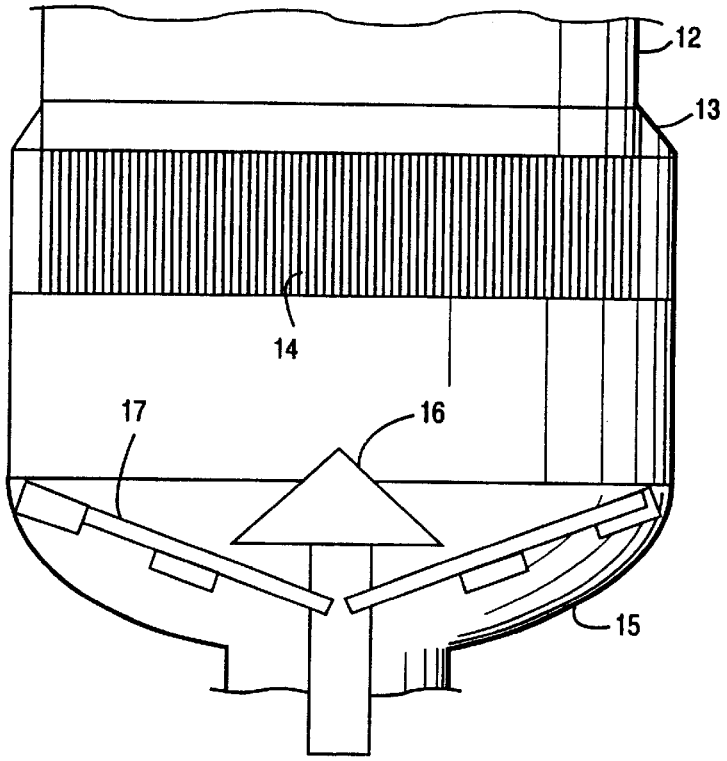
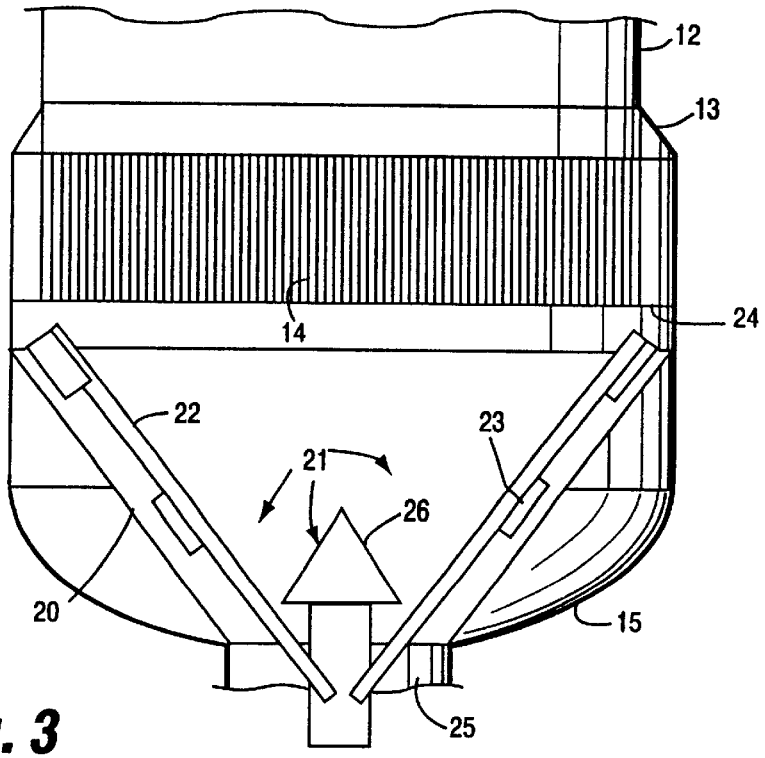
Fig. 3

METHOD OF MAKING A VESSEL ASSEMBLY FOR HANDLING COMMINUTED CELLULOSIC FIBROUS MATERIAL

This is a divisional of application Ser. No. 09/318,797 filed May 26, 1999, now U.S. Pat. No. 6,280,575 which claimed the benefit of U.S. Provisional Application No. 60/087,332, filed May 29, 1998, now abandoned, the entire content of which is hereby incorporated by reference in this application.

This application is based upon provisional application Serial No. 60/087,332 filed May 29, 1998.

BACKGROUND AND SUMMARY OF THE INVENTION

In the processing of comminuted cellulosic fibrous material in the production of cellulose pulp, the material is typically stored or treated in several cylindrical vessels. The material is typically discharged from these vessels through restrictions that communicate with conduits, that is, piping, through which the material is transferred to the subsequent treatment. In order to promote the movement of the cellulose material, typically in the form of a chip slurry or fiber slurry in liquid, from the vessel to the restriction of the discharge, some form of agitation is provided in the vicinity of the discharge. This agitation typically takes the form of a rotating agitator or discharge device that agitates the material and promotes its movement toward and through the discharge of the vessel.

However, the geometry of the bottom heads of conventional treatment vessels, in particular, the bottom heads of continuous digesters, typically require the material being processed to make a dramatic change in flow path. That is, the flow of material in conventional vessels is required to change from a essentially downward vertical direction to an essentially horizontal direction toward a centrally-located outlet. This change in flow direction is typically associated with the "knuckle" of typical dished heads used in treatment vessels. The change in direction, and the compression of the material that is accompanied by such changes of direction, can produce dramatic variations in the liquid content, that is, the consistency, of the material in the vicinity of the change in flow path. For example, the consistency may change from 10–15% in the middle of the vessel to 30 to 40% adjacent the wall of the vessel. These local changes in consistency can effect the flow of material at or above such regions and can also affect the flow and distribution of treatment liquids introduced in these areas.

Also, in the processing of cellulose material to make cellulose pulp for paper, it is undesirable to treat the material with a mechanical agitator, especially when the material is in a hot, alkaline state, as is typical in the bottom of chemical digesters. Agitation or the application of "mechanical action" to the material has been associated with physical damage to the material; damage that can result in reduced strength of the paper subsequently produced. For example, in some cases the discharge from vessels can be effected without the aid of mechanical action as disclosed in U.S. Pat. Nos. 5,700,355; 5,617,975; 5,628,873; 5,500,083; and 4,958,741 or Statutory Invention Registration H1681; this technology is marketed under the trademark Diamondback by Ahlstrom Machinery of Glens Falls, N.Y.

Also, the rotating agitators require energy to rotate the device in the slurry of material. Rotating discharge devices are typically powered by electric motors coupled to the device by means of a mechanical transmission, for example, a gear box, belt drive or chain drive. The amount of energy required to drive these devices is dependent upon the geometry of the agitating device, the diameter and height of the vessel, and the state of the material being agitated, for example, its liquid content, among other things.

As the production rate of material passing through the vessels increases, the height and diameter of the vessel must be enlarged to accommodate these larger production rates. This directly affects the loading on the agitating device and the amount of energy or power that must be used to rotate the agitating device. For instance, as the vessel diameter becomes larger, the diameter of the rotating device must also increase so that as much of the diameter of the vessel is "swept" by the rotating device. The rotating device typically has paddled "arms" which extend from a centrally-located hub. As the vessel diameter increases, the length of the arms must increase. However, as the length of the arm increases, the moment arm of the torque which must be supplied to agitate the material also increases. The increased torque required by the increased diameter of the vessel translates directly into an increase in power consumption required to agitate the material. Thus, it is preferred to have the smallest moment arm as possible for the rotating device in order to minimize the power required.

In addition to the diameter of the vessel, the height of the vessel also effects how much power must be provided to rotate the agitator. As the production rate of material passing through a treatment vessel increases, for a desired retention time in the vessel, again, either the diameter or the height of the vessel must increase. Typically, treatment vessels are designed to have a limited length-to-diameter ratio, that is, L/O or "L over D ratio". For example, for continuous digesters the L/O ratio is typically limited to a value less than 10. Typical production rates of vessels designed today exceed 500 tons of pulp per day[T/D], typically exceed 1000 T/D and approach 3000 T/D or more. Since the diameter of a vessel directly effects how much area the vessel will require, that is, how large a "foot print" the vessel will have, larger production rates are typically accommodated by increasing the vessel height, which typically comes at less cost to a mill, while limiting the L/D ratio as discussed above. (Of course, the diameter of such vessels may also be increased to provide the desired L/D ratio.) However, as the height of a vessel increases, the static head pressure on the material on the bottom of the vessel increases. As discussed above, this compression of the material in the bottom of the vessel is typically greatest in the vicinity of the lower head transition from vertical to horizontal and can affect the consistency and flow of the material and the flow of liquids in this area. In addition, localized regions of higher material consistency in the vicinity of the outlet and outlet agitator can increase the resistance of material to agitation and thus increase the power required to agitate the material.

The present invention addresses these limitations of the prior art and provides a vessel discharge with reduced compression of the material and reduced power requirements compared to vessels designed according to the existing art. In a broad embodiment of the invention there is provided a cylindrical vessel for storing or treating comminuted cellulosic fibrous material having a first cross section having a first diameter and a second cross section, below the first cross section, having a second diameter at least 20% less than the first diameter, wherein between the first cross section and the second cross section there is a transition from the first diameter to the second diameter. The second cross section is preferably a material outlet.

The treatment performed in the vessel may be chemical (e.g. kraft) pulping, delignification, washing, bleaching, or simply storage. The vessel is preferably a continuous digester or a continuous pretreatment vessel such as an impregnation vessel, but the present invention may also be used for non-continuous or batch-type treatments, for example, a batch digester.

The outlet of the digester preferably includes a means for agitating the material in the vicinity of the outlet in order to promote movement of the material, but based upon the geometry of the transition and the effectiveness with which the material can be transferred by the transition, an agitating device may not be necessary. If an agitator is required, due to the geometry of the transition, the power required to rotate the agitator may be at least 10% less than (e.g. at least 20% less than) a comparable conventional outlet and agitator.

The first diameter is typically at least 10 feet, preferably at least about 20 feet, and most preferably at least about 30 feet. The second diameter is typically at least 1 foot, preferably at least about 3 feet, most preferably at least about 5 feet.

The most preferred transition is a simple frusto-conical transition; however, other transitions may be used, such as a transition having one or more single convergences as disclosed in the U.S. patents listed above, or the transition may consist of a combination of single-convergence transitions and one or more frusto-conical transitions. One typical transition that can be used which is a combination of transitions consists of a first single-convergence transition from a first circular cross section having the first diameter to a second cross section having a race-track-oval type geometry followed by a second single-convergence transition from the second race-track-oval type cross section to a third circular cross section having a third diameter followed by a conical transition from the third circular cross section to a fourth circular cross section having a diameter equal to the second diameter. The third diameter is preferably greater than the second diameter.

The agitator for the material preferably comprises or consists of a device positioned in the outlet having a central hub which communicates with a drive mechanism. The device preferably has at least two arms attached to the hub and extending into the conical outlet such that the conical outlet is swept by the arms when the device is rotated. The arms typically include one or more paddles which aid in the agitation and transferring of the material to the outlet of the vessel. The diameter defined by the circular swipe of the arms is typically less than the third diameter.

Liquid may be introduced to the transition by nozzles or screens to aid in discharge of the material and to treat the material prior to discharge, for example, to cool or dilute the material.

The present invention also comprises or consists of a method of storing or treating cellulose material (e.g. at a consistency of about 10–15%) in a cylindrical vessel having a first diameter, a discharge having a second diameter, at least 20% less than the,first diameter, and a discharge agitator having a power requirement, comprising or consisting of (a) storing or treating the material in the vessel at a first diameter; (b) passing the material through a transition (e.g. a substantially smooth, substantially frusto-conical transition) from the first diameter to the second diameter; (c) agitating the material with the discharge agitator; and (d) discharging the material from the vessel through the discharge; and wherein the power requirement of the discharge agitator is at least 10–20% less than the power requirement without the transition.

According to one aspect of the present invention there is provided a method of handling comminuted cellulosic fibrous material in a cylindrical vessel having a first diameter, a discharge having a second diameter at least 20% less than the first diameter, and a discharge agitator having a power requirement. The method comprises: (a) Storing or treating the material in the vessel at the first diameter portion thereof. (b) Passing the material through a transition from the first diameter to the second diameter. (c) Agitating the material with the discharge agitator while in the transition. (d) Discharging the material from the vessel through the discharge. And practicing (b) and (c) so that the power requirement of the discharge agitator is at least 10% less than the power requirement without the transition.

Preferably (b) is practiced using a substantially smooth interior surface, substantially frusto-conical, transition. Also, (b) may be further practiced using a substantially frustoconical transition having an interior surface with a slope angle of between about 40–50 degrees to an imaginary line substantially perpendicular to the direction of flow of material through the transition. In the method the transition may comprise a first transition, and the method further comprises (e) passing the material through a single-convergent second transition prior to passing the material through the first transition, and wherein (b) and (c) are practiced so that the power requirement is at least 20% less. In the practice of the method (e) may be practiced by passing the material through a change in cross-section from substantially circular to substantially race-track-oval, and from substantially race-track-oval back to substantially circular.

Preferably (c) is practiced by rotating an agitator, having at least two arms with paddles, about an axis substantially parallel to and substantially concentric with the direction of flow of material through the transition, and wherein (b) and (c) are practiced so that the power requirement is at least 20% less. Typically (c) is further practiced by rotating an agitator having a deflector cone.

The invention is capable of ready implementation in pre-existing vessels, such as digesters and impregnation vessels. That is, typically the vessel does not initially have the transition, and the method then comprises the further step of retrofitting the transition into the vessel prior to the practice of (b) and (c).

In the method typically (a) is practiced by digesting or impregnating the material. The method may also comprise the further step of moving the transition during the practice of (b), such as vibrating it, oscillating it, or reciprocating it, utilizing any conventional structure capable of performing that function.

According to another aspect of the present invention there is provided a vessel assembly for handling comminuted cellulosic fibrous material, comprising: A substantially cylindrical substantially upright vessel having a first diameter material storing or treating portion above a second diameter discharge, the second diameter at least 20% less than the first diameter. And a substantially smooth interior surface, substantially frusto-conical transition between the first and second diameter portions.

In the preferred embodiment the transition interior surface comprises polished stainless steel, and the transition interior surface has a slope angle of between about 5–70 degrees to the vertical, preferably between 20–60 degrees, most preferably between 30–50 degrees. The first diameter is at least about 10 feet, and the second diameter is at least about 2 feet.

The assembly may further comprise an agitator disposed in the discharge and a transition, the agitator agitates material in the transition. For example, the agitator has at least two arms with paddles, and is mounted for rotation about a substantially vertical axis substantially concentric with the second diameter. In such a case the transition interior surface slope angle is between about 40–50 degrees to the horizontal. In one particular construction the vessel comprises a digester or impregnation vessel; and the assembly further comprises a withdrawal screen assembly located in the vessel just above the transition. A second single convergent transition may be provided disposed above the first transition, and the second transition may change in cross-section, from most remote from the first transition toward the first transition, from substantially circular to substantially race-track-oval, and from substantially race-track-oval back to substantially circular.

According to yet another aspect of the present invention there is provided a method of handling comminuted cellulosic fibrous material in a cylindrical vessel having a first diameter, a discharge having a second diameter at least 20% less than the first diameter. The method comprises: (a) Storing or treating the material in the vessel at the first diameter portion thereof. (b) Passing the material through a substantially smooth interior surface, substantially frusto-conical transition from the first diameter to the second diameter. And (c) discharging the material from the vessel through the discharge.

For example, (b) is further practiced without agitating the material within the transition, and using a substantially frusto-conical transition having an interior surface with a slope angle of between about 5–20 degrees to an imaginary line substantially parallel to the direction of flow of material through the transition. Utilization of a second transition, as described, may also be provided.

It is the primary object of the present invention to provide a vessel discharge with reduced compression of the cellulosic material, and reduced power requirements for any agitator therein compared to conventional vessels. This and other objects of the invention will become clear from an inspection of the detailed description of the invention and from the appended claims.

BRIEF DESCRIPTION OF THE DRAWINGS

FIG. 2 is a schematic single line cross sectional view of the discharge area of the prior art construction of FIG. 1;

FIG. 3 is a view like that of FIG. 2 only showing a vessel discharge area according to the invention, for practicing the method according to the invention.

DETAILED DESCRIPTION OF THE DRAWINGS

Figure 1:
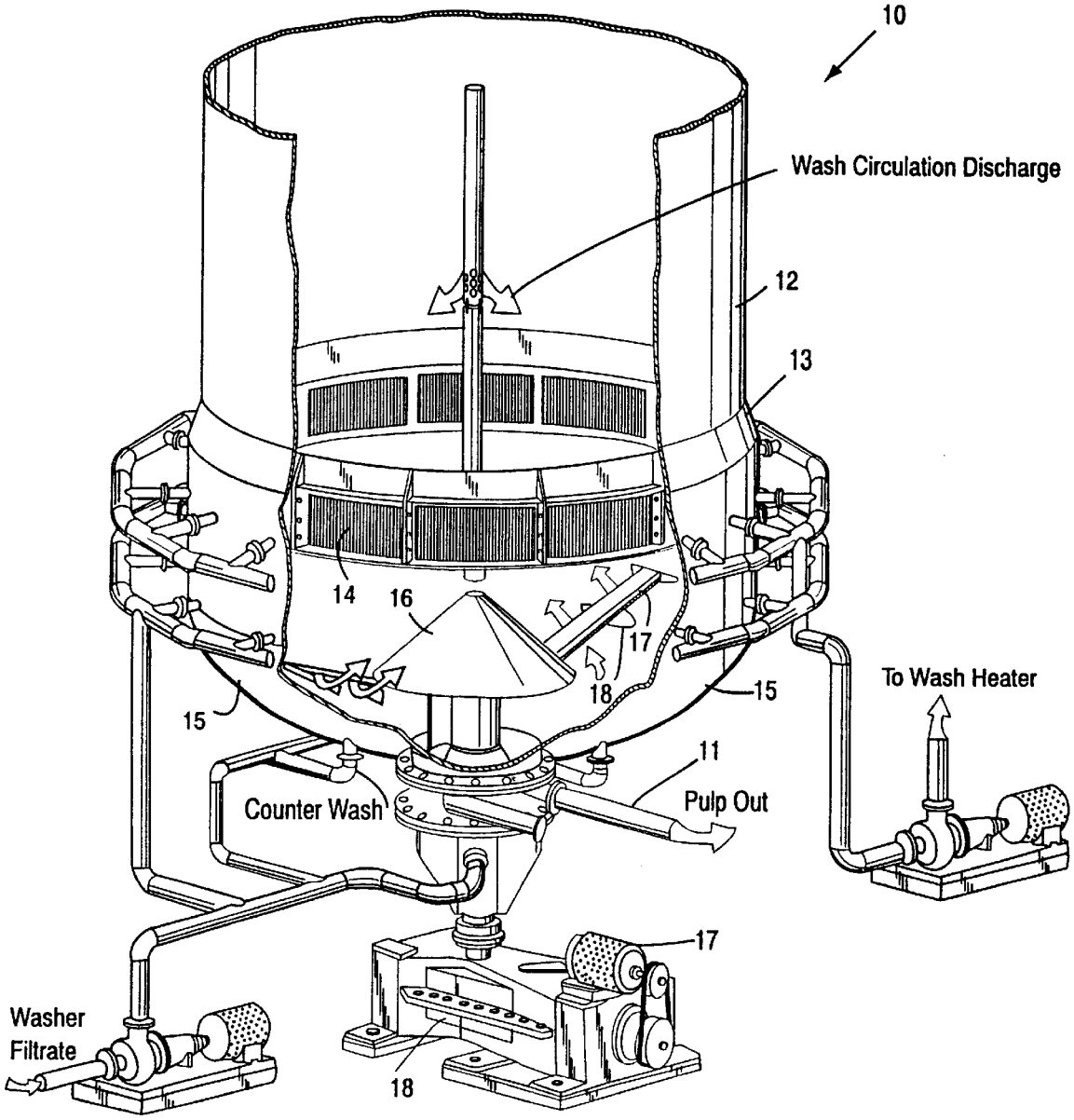
Fig. 1 (Prior Art)
FIG. 1 is a schematic elevational view, partly in cross-section, of a conventional prior art continuous digester bottom section.

FIG. 1 illustrates an elevational view, partly in cross section, of a typical prior art continuous digester bottom section 10 including a pulp outlet 11 according to the prior art. As is typical, the digester shell 12 includes a transition 13 to accommodate a screen assembly 14. The lower section of the shell includes a typical dished head 15. As is also typical, the outlet also includes a conventional rotating "outlet device" 16 having at least two somewhat radial arms 17 with paddles 18 which agitate the material and promote movement of the material toward the central outlet. The outlet device 16 also includes a conical baffle section which rotates with the outlet device. The outlet device 16 is driven by a direct drive electric motor 17 and gear box 18. As is typical, various liquors can be introduced to the lower section of the digester and to the outlet to cool and dilute the material prior to discharge.

FIG. 2 schematically illustrates a cross sectional view of the outlet shown in FIG. 1. FIG. 2 more clearly shows the dished head 15 of the conventional digester 10 bottom section and its relationship to the rotating scraper arms 17 of outlet device 16.

FIG. 3 schematically illustrates one embodiment of a vessel of the present invention, for practicing a method according to the invention, in which the elliptical surface of head 15 of FIG. 2 is replaced by a substantially smooth frusto-conical surface 20. Otherwise, the lower section of the digester shown in FIG. 3 is essentially identical to the lower section shown in FIG. 2, including the shell 12, transition 13, screen 14, and lower head 15. As a result, the cellulosic fibrous material (pulp) which passes through the lower outlet 25 shown in FIG. 3 is not subjected to as much compression and the resultant variation in consistency as in conventional dished outlets.

The outlet of FIG. 3 may also include an agitating device 21 having at least two arms 22 with paddles 23, the arms rotated about a substantially vertical axis by an electric motor or the like. The arms 22 preferably follow the contour of the substantially frustoconical transition 20 and preferably extend up underneath the "step-out" 24 of the screen assembly 14. The agitating device 21 may include a conical deflector cone 26, but a deflector cone 26 may not be necessary.

The substantially frusto-conical transition 20 is preferably made from stainless steel and the substantially smooth surface of the transition 20 is preferably polished to reduce friction. The angle of transition 20 is typically about 45° from the vertical, that is, between about 40° and 50° from the vertical. However, the angle of the conical transition 20 may be as small as about 10°, that is, between about 5 and 20°. When such shallow angles are used, an agitating device 21 may not be necessary.

The frusto-conical transition 20 itself may also be non-stationary, that is, it may be rotated, or agitated, or vibrated using any conventional structure for that purpose. A separate agitating device 21 may or may not be necessary if the transition 20 is non-stationary.

Figure 4:
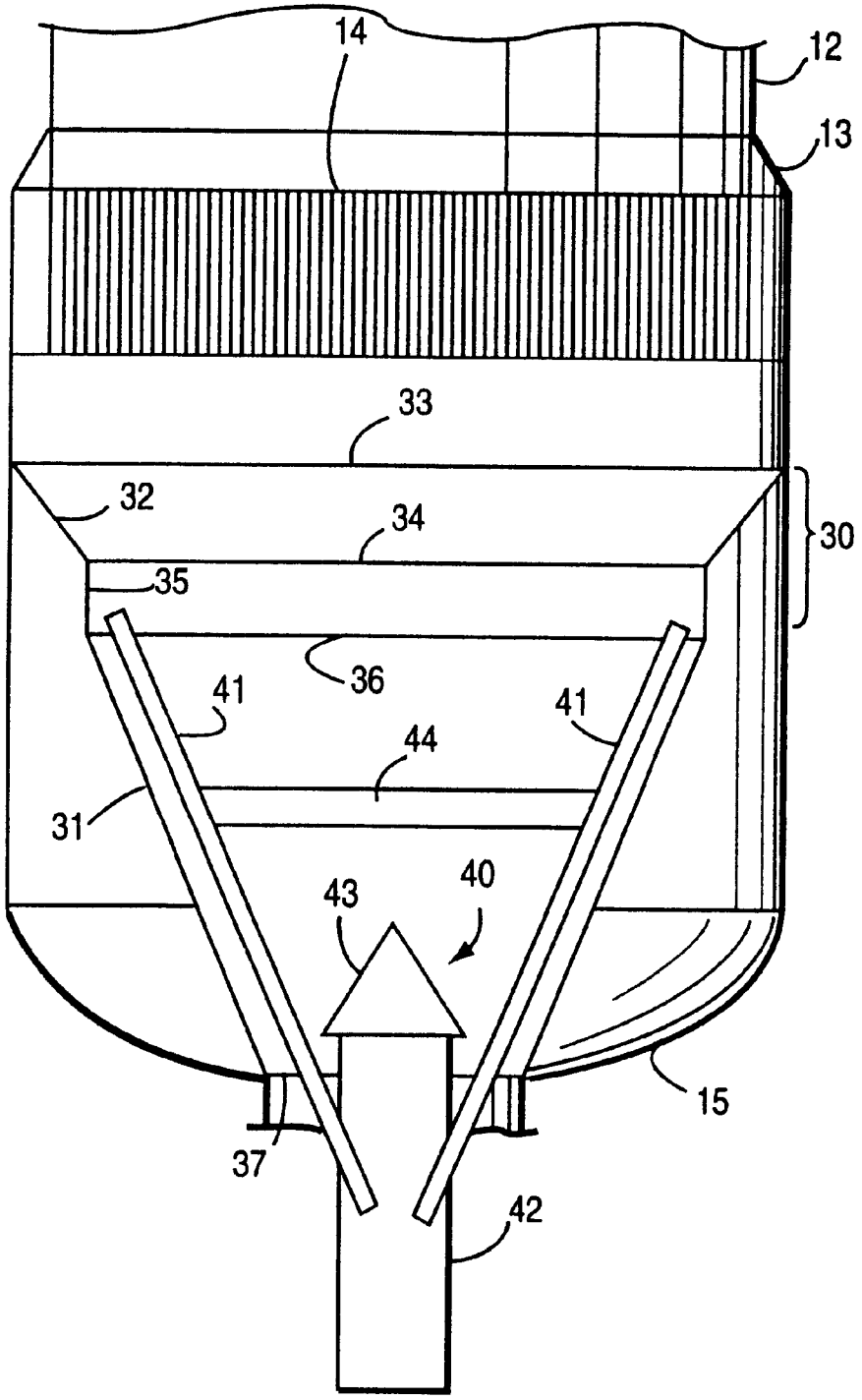
FIG. 4 is a view like that of FIG. 3 of a second embodiment of the invention.

FIG. 4 schematically illustrates another embodiment of the present invention in which the outlet transition comprises or consists of a single-convergent transition 30 and a substantially frusto-conical transition 31. The shell 12, transition 13, screen 14, and dished head 15 are as conventional. The transition 30 is similar to the single-convergence transitions disclosed in the above-referenced U.S. patents. The transition 30 comprises or consists of a first transition position 32 from a circular cross section 33 to a race-track-oval type cross section 34. The second transition position 35 of the transition 30 comprises or consist of a transition from the race-track-oval type cross section 34 to a circular cross section 36. The frusto-conical transition 31 is a transition from a circular cross section 36 to a circular cross section 37. Cross section 37 is preferably the outlet of the vessel 12. Transition 30 may also include two or more single-convergent transitions, that is, two or more of the transitions 30 shown.

If necessary, the outlet 37 shown in FIG. 4 may include an agitating device 40 having at least two arms 41, a hub 42, and a conical baffle 43. The arms 41 may include one or more paddles (not shown) as for the agitators in FIGS. 2 and 3. The arms 41 may be supported by one or more brackets or braces, such as schematically illustrated by the cross beam 44, as necessary.

It will thus be seen that according to the present invention a vessel assembly and a method of handling comminuted cellulosic fibrous material are provided which provide reduced compression of the material during discharge, and reduced power requirements when an agitator is utilized, compared to conventional vessels. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A method of making a vessel assembly for handling comminuted cellulosic fibrous slurry in liquid material comprising the steps of:

(a) providing a cylindrical treatment vessel which includes substantially upright first and second vessel portions respectively having first and second cross-sectional diameters such that said second diameter is at least 20% less than said first diameter, wherein said second vessel portion having a substantially smooth interior surface and an outlet for discharge of the cellulosic fibrous material;

(b) providing a substantially frusto-conical transition portion positioned between and joining said first and second vessel portions;

(c) positioning an agitator in the outlet of said second vessel portion and in said transition portion, said agitator having at least two arms and being mounted for rotation about a substantially vertical axis substantially concentric with said second vessel portion, wherein (d) said agitator is operable by rotation of the at least two arms about said substantially vertical axis so as to agitate the material in said transition portion such that said agitator exhibits a power requirement that is at least 20% less than the power requirement of the agitator in the absence of the transition portion.

2. The method of claim 1, wherein step (b) is practiced by providing a substantially frusto-conical transition having an interior surface with a slope angle of between about 5–20 degrees to an imaginary line substantially parallel to the direction of flow of material through the transition.

3. The method of claim 1, wherein step (b) is practiced by providing a first transition, and a single-convergent second transition through which the material passes prior to passing through the first transition.

4. The method of claim 3, wherein said second transition includes a sequential change in cross-section from substantially circular to substantially race-track-oval, and from substantially race-track-oval back to substantially circular.

5. The method of any one of claims 1–4, wherein step (b) includes retrofitting the transition into the vessel.

* * * * *